US006672459B1

(12) United States Patent
Nogalski

(10) Patent No.: US 6,672,459 B1
(45) Date of Patent: Jan. 6, 2004

(54) INTEGRATED TERMINAL DECK AND SPOUT FOR VIBRATING SEPARATOR AND METHOD OF FABRICATION

(75) Inventor: James F. Nogalski, Tulsa, OK (US)

(73) Assignee: Southwestern Wire Cloth, Inc., Tulsa, OK (US)

( * ) Notice: Subject to any disclaimer, the term of this patent is extended or adjusted under 35 U.S.C. 154(b) by 0 days.

(21) Appl. No.: 10/116,024

(22) Filed: Apr. 3, 2002

Related U.S. Application Data

(60) Provisional application No. 60/281,546, filed on Apr. 4, 2001.

(51) Int. Cl.[7] ..... B07B 1/00
(52) U.S. Cl. ..... 209/255; 209/259
(58) Field of Search ..... 209/255, 259

(56) References Cited

U.S. PATENT DOCUMENTS

| | | | | | |
|---|---|---|---|---|---|
| 790,572 | A | * | 5/1905 | Hickman | 209/355 |
| 1,105,327 | A | * | 1/1914 | Hodges | 209/414 |
| 1,437,884 | A | * | 12/1922 | Beal | 209/257 |
| 3,469,694 | A | * | 9/1969 | Dickson | 209/255 |
| 3,477,572 | A | * | 11/1969 | McKibben | 209/255 |
| 3,495,709 | A | * | 2/1970 | Kahane | 206/63.3 |
| 3,504,793 | A | * | 4/1970 | Eaton et al. | 209/255 |
| 3,650,401 | A | | 3/1972 | Riesbeck et al. | 209/325 |
| 3,666,095 | A | | 5/1972 | Krynock et al. | 209/254 |
| 3,794,165 | A | | 2/1974 | Riesbeck et al. | 209/325 |
| 4,065,382 | A | | 12/1977 | Derrick, Jr. | 209/313 |
| 4,155,840 | A | * | 5/1979 | Gauld et al. | 209/245 |
| 4,319,991 | A | * | 3/1982 | Crone, Jr,.et al. | 209/255 |
| 4,384,952 | A | * | 5/1983 | Parsons et al. | 209/255 |
| 4,911,834 | A | | 3/1990 | Murphy | 210/167 |
| 5,199,574 | A | | 4/1993 | Hollyfield, Jr. et al. | 209/315 |
| 6,024,228 | A | | 2/2000 | Williams | 209/272 |

FOREIGN PATENT DOCUMENTS

EP 0 419 033 A1 * 3/1991

* cited by examiner

*Primary Examiner*—Donald P. Walsh
*Assistant Examiner*—Jonathan R Miller
(74) *Attorney, Agent, or Firm*—Head, Johnson & Kachigian

(57) ABSTRACT

An integrated terminal deck and spout assembly for a vibrating separator and a method of fabricating a terminal deck constructed such that the deck has a protruding tongue which extends out past the deck blank. The protruding tongue forms the bottom plate of the discharge spout. This reduces the number of parts necessary to assemble a terminal deck. It also provides a structurally stronger discharge spout than found in the prior art and reduces the time and labor necessary to assemble a terminal deck. This change in design also reduces fatigue cracking in the deck blank near the terminal deck discharge spout.

6 Claims, 4 Drawing Sheets

INTEGRATED TERMINAL DECK AND SPOUT FOR VIBRATING SEPARATOR AND METHOD OF FABRICATION

CROSS-REFERENCE TO RELATED APPLICATIONS

Priority is claimed from provisional application U.S. Ser. No. 60/281,546 filed on Apr. 4, 2001, and incorporated by reference herein.

BACKGROUND OF THE INVENTION

1. Field of the Invention

In general, the present invention relates to vibrating separators. In particular, the present invention relates to the design and fabrication of terminal decks typically used with vibrating separators.

2. Prior Art

Many industries utilize vibrating separators to classify certain solid materials by size or to separate solid material from liquid material. In either case, the material is fed to at least one screen surface which retains the oversize particles and allows the smaller particles or the liquid to pass therethrough. A vibrating, shaking or agitating motion is imparted to the screen to effect a more efficient separation and to move the oversize particles on the screen to a discharge area or chute generally located at the periphery of the screen. Specific applications range greatly from food processing to chemical processing to oil field production. In a typical food processing application, a vibrating separator is used to separate various food products according to their size. Vibrating separators used in the food processing industry must be built to exacting industry specifications for sanitation. In chemical processing applications, a vibrating separator can be used to remove particles or debris larger than a preset size from a slurry stream. Vibrating separators are also used in oil production. In oil production, the vibrating separator is typically used to remove larger pieces of debris from recirculated drilling fluids.

The vibrating separators of the prior art are generally constructed of the following major components. A separator blank generally consists of a cylindrical or box-shaped metal structure that is open at the top and bottom ends. Within the separator blank is a screen surface which has tiny openings sized to separate out particles of a particular size while liquids or smaller particles pass through. Located on the peripheral surface of the separator blank is a discharge spout which facilitates the removal of the particles which do not pass through the screen. If the vibrating separator is to be utilized to separate particles of more than one size in a single operation several separator blanks may be stacked on top of each other utilizing successively finer screen sizes. Where several separator blanks are used, the upper separator deck is called the spacing frame or top deck and each successive deck will be called a distribution frame or an intermediate deck. Functionally, without if a larger than normal motion generator, the mass of the decks make more than three or four decks prohibitive.

Located below the separator blank or blanks is a table frame or terminal blank so called because material will not continue through it, but rather will be directed towards the discharge spout on the outside of the blank. The terminal blank generally consists of a cylindrical or box-shaped metal structure constructed in a similar fashion to the separator blank with the exception that instead of a screen, the bottom of the terminal blank is enclosed by a terminal deck plate.

The terminal deck plate consists generally of an elliptically-shaped metal sheet which is welded or otherwise secured to the inside of the terminal blank at an angle so as to provide a sloping surface that directs the flow of liquid or solid particles that pass though the screens of the separator deck or decks above to the discharge spout located on the peripheral wall of the terminal blank. The separator blank and terminal blank are attached together by bolts or by some type of fastening, clamping or latching means. Terminal decks come in basically two forms: scalping decks and table frame decks. The scalping deck is designed to allow large volumes of material to flow from the unit quickly. For this reason, it has a sloped surface. A table frame deck consists of a cylindrical body, discharge spout, and domed or convex terminal deck. The convex bottom acts to convey material falling from the screen above to the outside of the deck, then the motion of the machine will propel it toward and out of the spout.

The terminal deck and decks fastened to it are fastened to a motion generating assembly with bolts clamps or other fasteners. The motion generating assembly consists of a motor with eccentric weights fastened to a disk or annulus equal in diameter to the decks.

Vibration of the unit may be achieved by means of an electric, hydraulic, or pneumatic motor. While the vibrating motion of the vibrating separator allows for a great increase in efficiency over non-vibrating separator screens, the constant vibrating motion greatly increases the mechanical stresses on the equipment. The forces experienced can be in the range of 3 to 8 times the force of gravity.

One common result is stress cracks that form in the side of the terminal blank where the discharge spout is welded to the terminal blank. This failure is due to fatigue at the junction of the discharge spout and the terminal blank. The failure is accelerated by localized heat embrittlement of the metal resulting from welding. The terminal deck discharge spouts of the prior art were constructed separately from the blank.

Discharge spouts are generally comprised of three separate pieces of sheet metal cut and bent into shape and then welded together to form the separate terminal deck discharge spout. The discharge spout was then welded on to the outside wall of the deck blank. When the vibrating separator was put into service, the forces exerted on the discharge spout result in metal fatigue and stress cracks in the terminal blank where the weld joints are located.

Another problem present in the vibrating separators of the prior art is the weldjoint that joins the discharge spout to the terminal deck. In order for the vibrating separator to meet industry specifications for food grade equipment which are well known to those of ordinary skill in the prior art, the weld joints joining the discharge spout to the terminal deck must be ground smooth and polished. This extra step of grinding and polishing the weld is labor intensive and adds to the cost of manufacture of the vibrating separator. An example of a vibrating separator of this design is shown by U.S. Pat. No. 3,650,401 which shows a vibrating separator wherein the discharge spout is welded to the peripheral surface of the terminal blank with a joint where the terminal deck butts up against the discharge spout. Solutions offered in the prior art for the failure of terminal deck discharge spouts include gussets and stress relief straps. Others have simply used heavier metal on the deck and spout.

Another attempt to address the problems of the prior art is seen in U.S. Pat. No. 3,794,165 which discloses a terminal deck with a flange extending beyond the peripheral wall of the terminal blank forming a surface which supports the discharge spout but the flange does not actually form part of the spout itself. While the addition of this supporting flange would possibly help to prevent some of the metal stress to the terminal blank, this might increase the strength of the deck at the flange, but would not help the spout failure issue caused by stress where the spout meets the terminal blank. Moreover, the flange does not eliminate the weld joint where the terminal deck butts up against the discharge spout.

Thus, there is a need for a terminal deck assembly which provides greater support for the discharge spout thereby reducing the amount of metal fatigue resulting in greater service life. There is also a need for a terminal deck assembly which minimizes the number of welds which must be ground and polished at great expense of time and labor in order to meet industry specifications for food processing equipment.

BRIEF SUMMARY OF THE INVENTION

In general, the present invention is a new and improved terminal deck assembly for a vibrating separator which is formed from a single piece of sheet metal, such as but limited to, carbon steel, stainless steel, aluminum or another suitable metal. The terminal deck plate of the present invention differs from the prior art in that instead of an elliptical shape the terminal deck plate of the present invention incorporates a tongue which protrudes out through the wall of the terminal blank or container body forming the bottom of the discharge spout. The terminal deck plate of the present invention could also be square or rectangular or any other shape that corresponds to the shape and dimensions of the vibrating separator in which it is used. The terminal deck discharge spout is then fabricated out of two pieces of bent metal which are then welded onto the protruding tongue and the container body. The added support provided by the protruding tongue of the terminal deck plate greatly increases the structural strength of the joint between the discharge spout and the container body and results in increased service life of the equipment. In addition, the terminal deck plate of the present invention eliminates the weld joint between the terminal deck and the discharge spout resulting in labor and cost savings due to the reduction in the number of weld joints which must be ground and polished smooth in order to meet food industry specifications. The protruding tongue of the present invention can be incorporated into both scalping decks and table frame decks.

It is also contemplated that the terminal deck assembly and discharge spout could be constructed of a single sheet of metal with the spout being integral to the terminal deck plate and folded from a single sheet of metal.

In addition, it is contemplated that the terminal deck plate and spout assembly could be formed or molded as a single piece from plastic, a polymer material such as fiberglass, carbon fiber or any other similar material. The terminal deck plate and spout assembly could also be formed integral to the terminal blank assembly as a single piece formed or molded from plastic, a polymer material such as fiberglass, carbon fiber or any other similar material.

It is further contemplated that the vibrating separator of the present invention could be built with multiple stages with different sized separator means, such as but not limited to, screens in order to separate out different sized particles in a single operation.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

Figure 1:
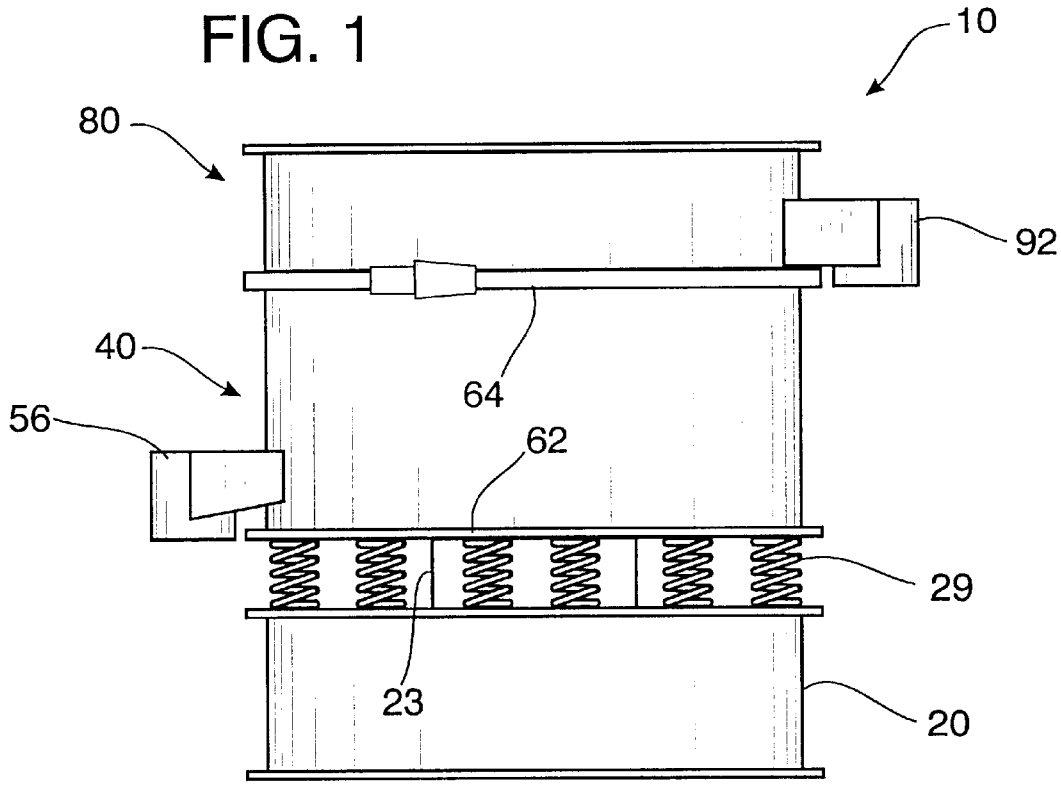
FIG. 1 is a side view of a vibrating separator with a terminal deck assembly constructed in accordance with the present invention.
Figure 2:
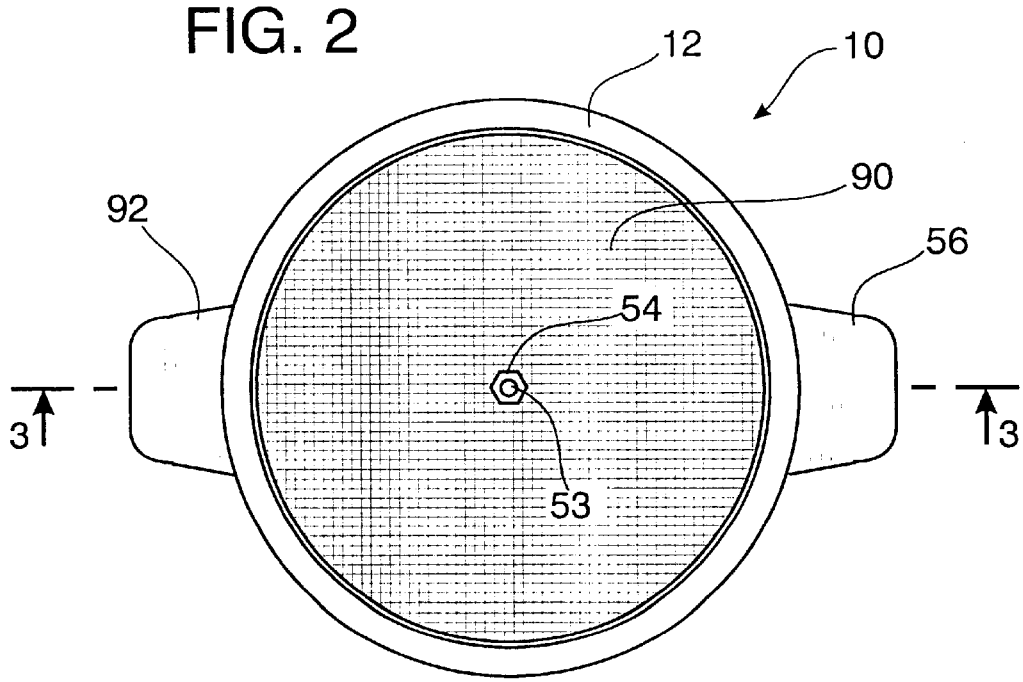
FIG. 2 is a top view of a vibrating separator with a terminal deck assembly as shown in FIG. 1.
Figure 3:
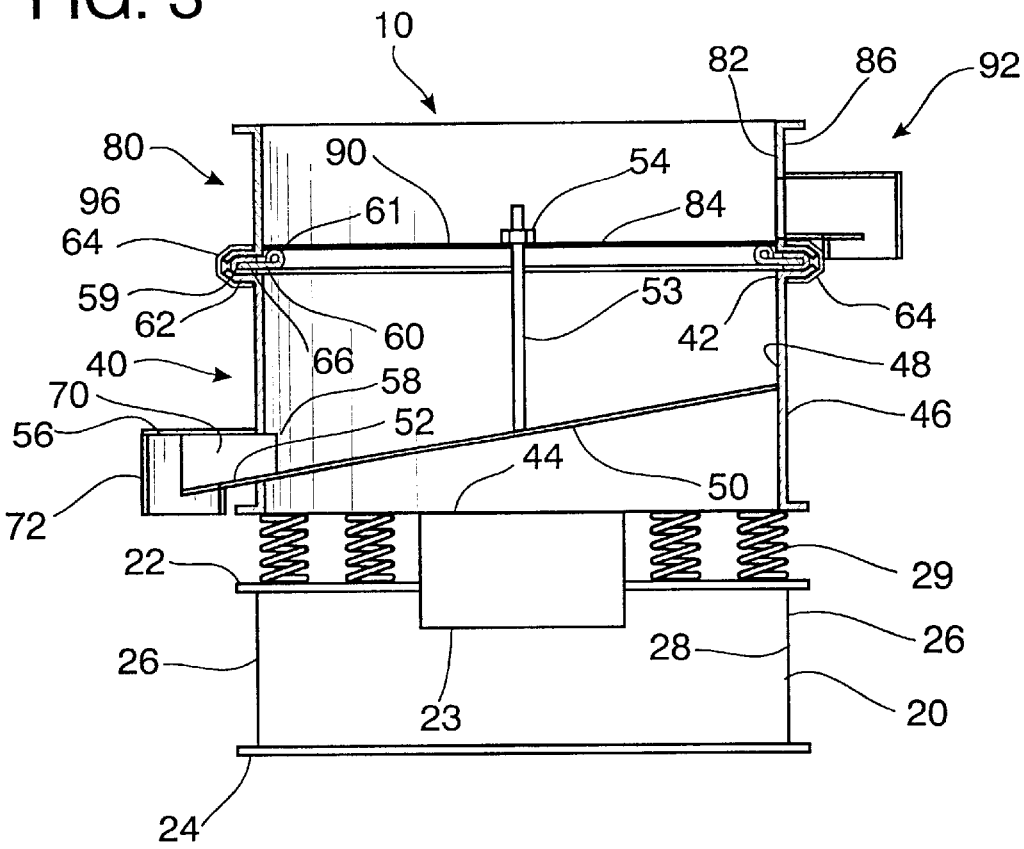
FIG. 3 is a cross-sectional side view of a vibrating separator with a terminal deck assembly taken along section line 3—3 of FIG. 2.

Referring now to the drawings in detail, as shown FIG. 1 and designated by the general reference numeral 10 is a vibrating separator constructed in accordance with the present invention. The vibrating separator 10 generally comprises a base 20, a terminal blank 40 and a separator blank 80. As shown in FIG. 3, the base 20 has a first end 22, a second end 24, an outside surface 26 and an inside surface 28. Attached to the first end 22 of the base 20 is the terminal blank 40.

Figure 4:
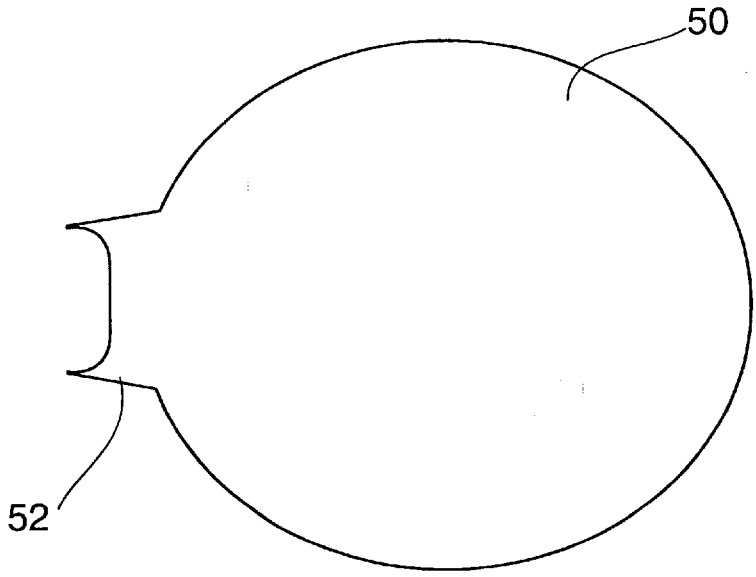
FIG. 4 is a top view of a terminal deck plate constructed in accordance with the present invention apart from the vibrating separator.

Now referring to FIGS. 3 and 4, the terminal blank 40 has a first end 42, a second end 44, an outside surface 46, an inside surface 48 and a terminal deck discharge spout opening 58. The second end 44 interfaces with an annular plate that is attached to the motion generator. This annulus or disk supports the terminal deck. In turn, the annulus/motion generator assembly is supported by the springs 29. Also, attached to the first end 22 of the base 20 and the second end 44 of the terminal blank 40 is a motion generator 23 (illustrated as a box). The motion generator may take an number of forms as is known in the art.

Mounted to the inside surface 48 of the terminal blank 40 is a terminal deck plate 50. The terminal deck plate 50 consists of an elliptically-shaped metal sheet with a protruding tongue 52. The terminal deck plate 50 is welded or otherwise secured to the inside surface 48 of the terminal blank 40 at an angle so as to provide a sloping surface that directs the flow of liquid or solid particles to the terminal deck discharge spout opening 58. The protruding tongue 52 is positioned so as to extend through the terminal deck discharge spout opening 58 of the terminal blank 40. Welded to the outside surface 46 of the terminal blank 40 over the terminal deck discharge spout opening 58 is a terminal deck discharge spout 56.

Figure 5:
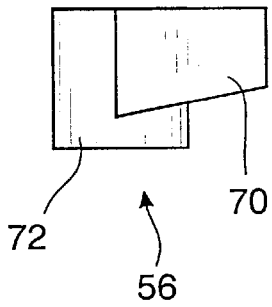
FIG. 5 is a side view of the terminal deck discharge spout constructed in accordance with the present invention.
Figure 6:
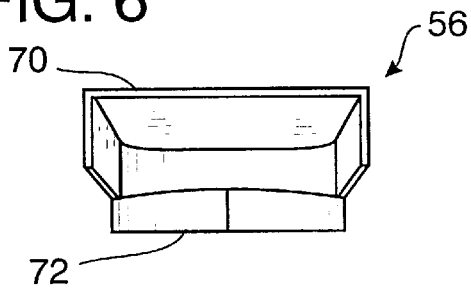
FIG. 6 is a front view of the terminal deck discharge spout shown in FIG. 5.
Figure 7:
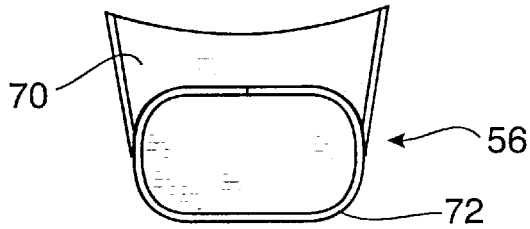
FIG. 7 is a bottom view of the terminal deck discharge spout shown in FIG. 5.
Figure 8:
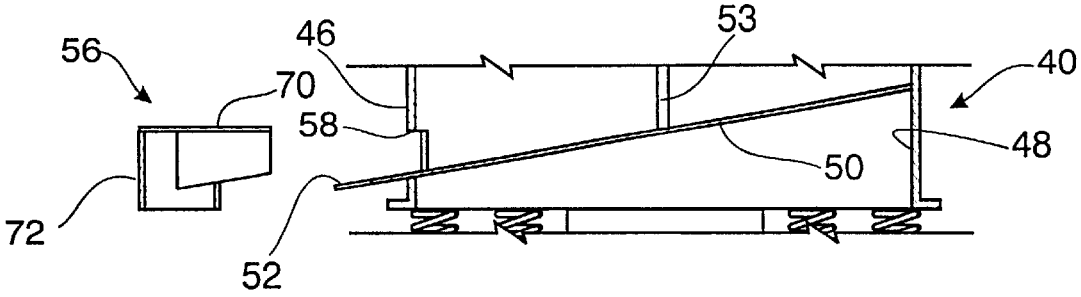
FIG. 8 is a cross-sectional side view of a terminal deck assembly constructed in accordance with the present invention.

The terminal deck discharge spout 56, shown in FIGS. 5–7, is constructed of a hood 70, a down spout 72 and the protruding tongue 52. The hood 70 and the down spout 72 are each formed of a single sheet of metal that is bent into shape. The hood 70 and the down spout 72 are welded together and then attached to the outside surface 46 of the terminal blank 40 with the protruding tongue 52 forming the bottom plate of the terminal deck discharge spout 56 (as shown in FIG. 3).

The first end 42 of the terminal blank 40 has a first flange 62. Attached to the first end 42 of the terminal blank 40 is the separator blank 80. The separator blank 80 has a first end 82, a second end 84, an outside surface 86 and an inside surface 88. The second end 82 of the separator blank 80 has a second flange 96. The separator blank 80 is attached to the terminal blank 40 by means of a coupling comprised of the first flange 62 of the terminal blank 40, a circular ring 60, a C-shaped band clamp 64, a circular gasket 66 and the second flange 96 of the separator blank 80. The circular ring 60 has an outside surface 59 and an inside surface 61. The inside surface 61 is rolled to provide extra strength. The inside surface 61 of the circular ring 60 extends inwardly inside to the separator blank 80 and provides a circular shelf to support a screen 90. The screen 90 is secured to the circular ring 60 by a center guide 53 and a center guide locking device 54. When the vibrating separator 10 is in use, the motion generator 23 provides vibrational motion to the terminal blank 40 and the separator blank 80. The product to be separated (not shown) enters through the top of the separator blank 80 and proceeds to flow through the screen 90. Particles (not shown) which are larger than the holes (not shown) in the screen 90 are captured by the screen 90 and are conveyed by the vibration over to a separator blank discharge spout 92. The majority of the product (not shown) continues through the screen 90 and onto the terminal deck plate 50 where it is conveyed by gravity and the vibration to the terminal deck discharge spout 56 and out of the vibrating separator 10.

There are a number of advantages achieved. For example, the present invention reduces the costs of producing a food grade vibrating separator by eliminating the weld where the terminal deck discharge spout 56 is joined to the terminal deck plate 50.

The present invention also provides for increasing equipment service life by reducing fatigue cracking of the terminal blank 40 where the terminal deck discharge spout 56 is welded to the terminal blank 40.

Figure 9:
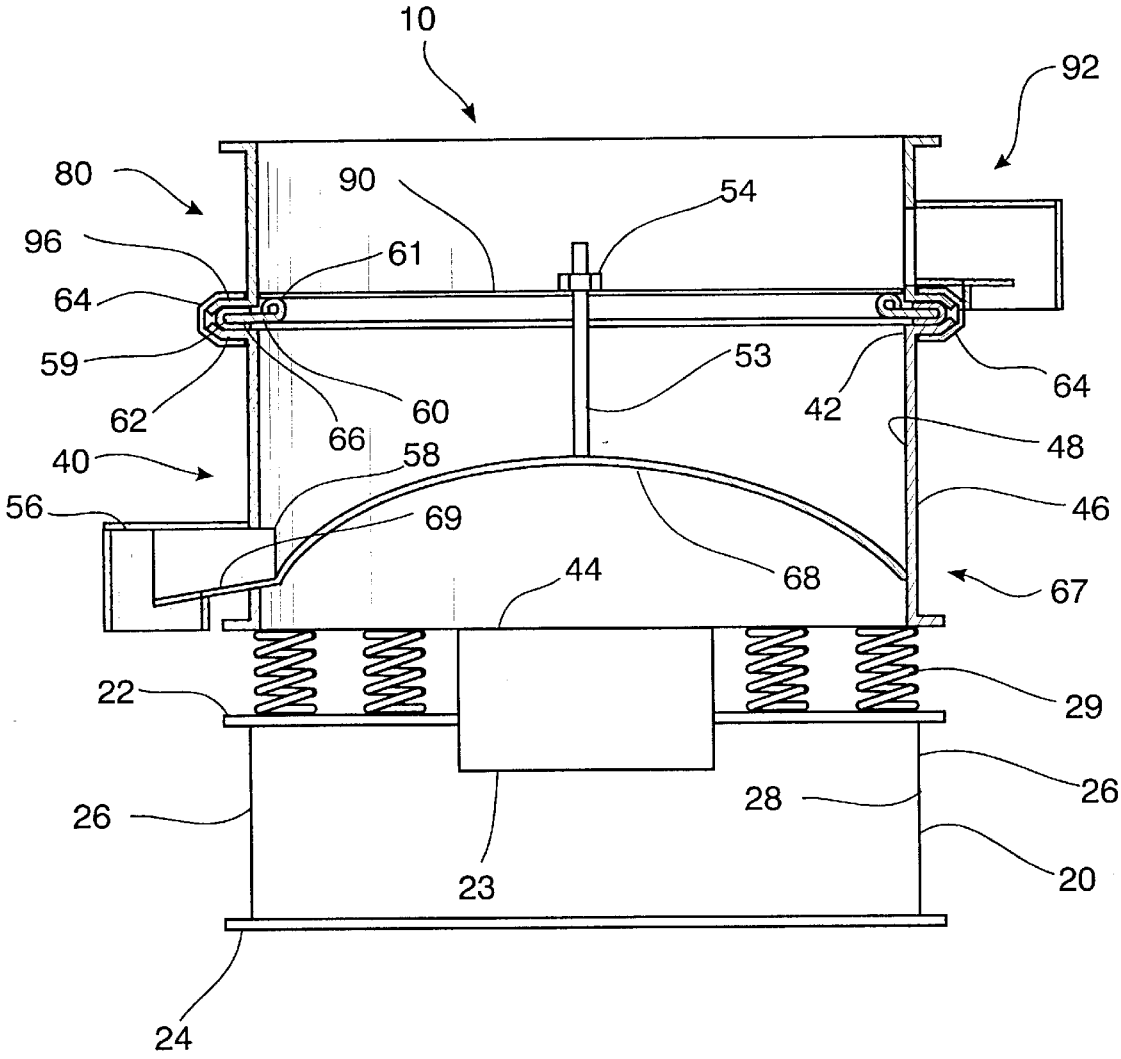
FIG. 9 illustrates a cross-sectional view of an alternate embodiment constructed in accordance with the present invention.

An alternative embodiment of the present invention incorporating the present invention in a table frame terminal deck 67 is shown in the cross-sectional view shown in FIG. 9. FIG. 9 shows the present invention incorporating a domed terminal deck 68 in place of the elliptically shaped terminal deck plate 50 as shown in FIG. 1. In this alternative embodiment, the domed terminal deck 68 would be substantially circular and welded into the terminal blank 40. The domed terminal blank 68 would have a protruding tongue 69 which would extend outside the terminal blank 40 and form part of the terminal deck discharge spout 56 of the vibrating separator 10.

Another alternative embodiment of the present invention (not shown) incorporates a terminal deck and terminal deck discharge spout formed out of a single piece of sheet metal wherein the terminal deck discharge spout is cut folded and welded to form a spout that is integral to the terminal deck.

Another alternative embodiment of the present invention (not shown) incorporates a terminal deck plate and terminal deck discharge spout wherein a terminal deck plate and terminal deck discharge spout are formed or molded as a single piece from a polymer material such as plastic, fiberglass, carbon fiber or any other similar material.

Another alternative embodiment of the present invention (not shown) incorporates a terminal blank wherein the terminal blank, terminal deck plate, and terminal deck discharge spout are formed or molded as a single piece from a polymer material such as plastic, fiberglass, carbon fiber or any other similar material.

Another alternative embodiment of the present invention (not shown) incorporates a top blank and multiple intermediate blanks with progressively finer screen sizes stacked on top of each other so that particles of different sizes may be separated out in a single operation.

Another alternative embodiment of the present invention incorporates the terminal deck plate of the present invention in a rectangular or box shaped vibrating separator.

Yet another alternative embodiment of the present invention incorporates a single container body which incorporates a separator means such as a screen, a terminal blank and a terminal blank discharge spout.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

What is claimed is:

1. A vibrating separator, comprising:

a cylindrical walled container body, including a woven wire screen separator to separate particles of different sizes, a terminal deck plate to gather together particles that have passed through said separator and direct said particles towards a terminal deck discharge spout opening located on the periphery of said cylindrical walled container body and out through a terminal deck discharge spout wherein said terminal deck plate being constructed of a flat piece of material installed in said container body to provide a sloped surface to said terminal deck;

said terminal deck plate has a protruding tongue which extends through said terminal deck discharge spout opening;

said terminal deck plate and said terminal deck discharge spout are formed out of a single planar piece of material; and said protruding tongue forms a bottom plate for said terminal deck discharge spout.

2. A vibrating separator according to claim 1 wherein said container body includes a separator blank containing said separator, a terminal blank containing said terminal deck plate and said terminal deck discharge spout and a base.

3. A vibrating separator according to claim 1 wherein said vibrating separator has multiple separator blanks stacked on top of each other for separating out particles of different sizes in a single operation.

4. A vibrating separator according to claim 1 wherein the terminal deck plate and terminal deck discharge spout are molded or formed in one piece from a polymer material.

5. A vibrating separator according to claim 1 wherein said container body is formed from sheet metal.

6. A method to fabricate a vibrating separator which method comprises:

fabricating a terminal deck plate having an elliptical external shape and a protruding tongue formed from a single planar piece of material;

installing said terminal deck plate in a cylindrical walled container body with said tongue extending through an opening in said container body and fastening said terminal deck thereto; and fastening a discharge spout to said terminal deck tongue and said container body.

* * * * *